US005418759A

United States Patent [19]

Fiebiger et al.

[11] Patent Number: 5,418,759

[45] Date of Patent: May 23, 1995

[54] ULTRASOUND TRANSDUCER ARRANGEMENT HAVING AN ACOUSTIC MATCHING LAYER

[75] Inventors: Clemens Fiebiger; Erhard Schmidt, both of Erlangen, Germany

[73] Assignee: Siemens Aktiengesellschaft, Munich, Germany

[21] Appl. No.: 120,339

[22] Filed: Sep. 14, 1993

[30] Foreign Application Priority Data

Sep. 28, 1992 [EP] European Pat. Off. ..... 92116561

[51] Int. Cl.[6] ..... H04R 17/00

[52] U.S. Cl. ..... 367/140; 367/152; 310/323; 310/336; 128/662.03

[58] Field of Search ..... 367/140, 152, 162, 176; 310/323, 328, 336, 337; 128/662.03, 660.01

[56] References Cited

U.S. PATENT DOCUMENTS 3,968,055 7/1976 Palmer ..... 252/506

4,717,851 1/1988 Fenner et al. ..... 310/334

FOREIGN PATENT DOCUMENTS 0031049 7/1981 European Pat. Off. .

0095619 12/1983 European Pat. Off. .

*Primary Examiner*—J. Woodrow Eldred

*Attorney, Agent, or Firm*—Hill, Steadman & Simpson

[57] ABSTRACT

In an ultrasound transducer arrangement having an electroacoustic transducer part, at least one acoustic matching layer is allocated to the transducer part. The acoustic matching layer is composed of an electrically conductive skeleton having interspaces connected to one another. The skeleton is constructed of particles connected to one another. The size of the particles is smaller than the wavelength of an acoustic wave in a matching layer, as a result of which no significant scattering of the wave occurs in the matching layer. The interspaces are filled with a curable casting compound.

9 Claims, 1 Drawing Sheet

ULTRASOUND TRANSDUCER ARRANGEMENT HAVING AN ACOUSTIC MATCHING LAYER

BACKGROUND OF THE INVENTION

1. Field of the Invention

The present invention is directed to an ultrasound transducer arrangement having an electroacoustical transducer part to which at least one acoustic matching layer is allocated.

2. Description of the Prior Art

Matching layers are employed in ultrasound technology in order to reduce reflections outside an examination subject at boundary surfaces between two materials having different impedance, or to transmit the ultrasound energy from the transducer part into the examination subject and back with as little loss as possible. To that end, at least one matching layer is arranged between the two materials. For example, matching layers are employed for acoustic matching of an electroacoustic transducer part to an examination subject. In addition, an acoustic sump or damping member having at least one matching layer can be adapted to the transducer part.

U.S. Pat. No. 4,717,851 discloses an ultrasound transducer arrangement of this type. For acoustic matching of the electroacoustic transducer part to an examination subject or to an acoustic propagation medium, matching layers are arranged in the sound propagation path, their acoustic impedance lying between that of the transducer part and that of the examination subject or propagation medium. Matching layers composed of a synthetic resin such as, for example, epoxy resin, wherein superfine particles of a mineral or metallic material are imbedded, are standard. The acoustic impedance of the matching layer is thereby essentially set by the quantity and the material of the added particles. A uniform distribution of the particles in the synthetic resin, however, cannot always be achieved over larger volume regions. As a result, the reproduceability of the function-determining acoustic properties is limited. Moreover, inhomogeneities and voids must be accepted under certain circumstances. Such matching layers are electrically non-conductive; the transducer part must therefore be additionally electrically contacted and/or shielded.

European Application 0 031 049 discloses an acoustic transducer arrangement for testing materials that is suitable for employment at high temperatures. The transducer arrangement includes a lead part composed of a metallic member having high specific attenuation. A sintered metal is proposed as the material for this member. The high specific attenuation is thereby decisively influenced by the porosity. A high specific attenuation, however, is undesirable in acoustic matching layers, particularly in medical applications.

SUMMARY OF THE INVENTION

An object of present the invention is to specify a simply constructed ultrasound transducer arrangement having an acoustically uniform matching layer whose function-defining properties can be set within a broad range.

This object is achieved in a transducer arrangement constructed in accordance with the principles of the present invention having an acoustic matching layer is composed of an electrically conductive skeleton having interspaces connected to one another. The skeleton is constructed of particles connected to one another with the size of the particles being smaller than the wavelength of an acoustic wave in the matching layer. As a result, no significant scatter of the wave occurs in the matching layer. The interspaces are filled with a curable casting compound. The electrically conductive skeleton simplifies the structure of the ultrasound transducer arrangement because the electroacoustic transducer part can be contacted or shielded via the matching layer. The acoustic impedance can be set within broad ranges via the selection of material and the size of the particles, so that the greatest variety of acoustic matching problems can be solved. The size of the particles is dependent on the ultrasound frequency employed. The particles can be larger as the frequency becomes lower without effecting a disturbing scatter of the ultrasound wave. The smallness of the particles also assures a uniform distribution of the acoustic impedance.

In one embodiment, the volume occupied by the particles in the matching layer lies between 5% and 95% of the total layer volume. Given low volume percentages, the curable casting compound guarantees adequate mechanical stability. It has also been shown that the interspaces remain connected to one another even given a volume percentage of the particles of 95%, so that matching layers having a high volume percentage of particles can also be manufactured without air inclusions.

In another embodiment, the volume percentage of the particles lies between 10% and 60%. Matching layers wherein the volume percentage of the particles lies in this range can be manufactured without complicated manufacturing measures.

In another embodiment, the particles are all of the same type, thereby achieving an especially high homogeneity.

In another embodiment, the particles are dendritically shaped, which facilitates the manufacture of matching layers having a low volume percentage of particles being capable of being manufactured as a result thereof.

In another embodiment, the particles are spherically shaped, which facilitates the manufacture of matching layers having medium and high particle volume percentages.

In another embodiment, the particles contain copper. Copper particles can be well-sintered under a protective atmosphere and can be obtained in various particle shapes such as, for example, spherical or dendritic shapes.

In another embodiment, the casting compound is a curable synthetic resin. The interspaces can thus be filled with the casting compound at normal ambient temperature.

In another embodiment, the matching layer immediately adjoins the exit surface of the transducer part (which, for echoes reflected from a subject, is also an entry surface). The matching layer thus fulfills the function of acoustic matching and simultaneously fulfills the function of the electrode contacting to the electroacoustic transducer part.

In another embodiment, the transducer part is fashioned for medical applications. The inventive matching layers are especially well-suited for matching the impedances occurring in the medical field to one another.

DESCRIPTION OF THE PREFERRED EMBODIMENTS

Figure 1:
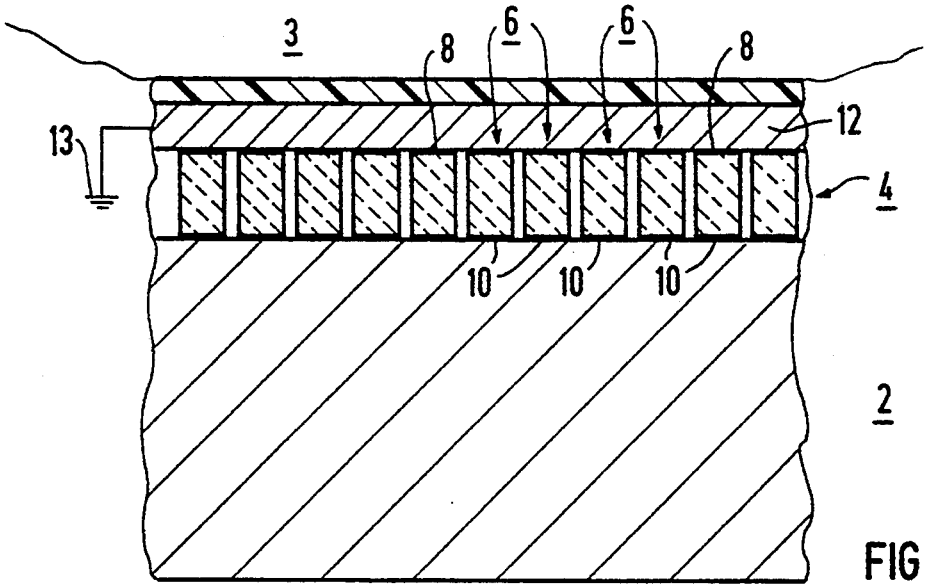
FIG. 1 is a side sectional view of an ultrasound transducer arrangement for medical applications having an electrically conductive matching layer constructed in accordance with the principles of the present invention.

FIG. 1 shows a sectional view of an ultrasound transducer arrangement 2 for medical applications, with which tomograms of an examination region 3 can be produced. Another medical application is comprised for detecting the location, direction and size of blood flows. The ultrasound transducer arrangement 2 includes a transducer array as the electroacoustical transducer part 4 for transmitting ultrasound waves into the examination region 3 and for receiving echo signals therefrom. The electroacoustic transducer arrangement formed by the transducer array 4 is composed of a plurality of identical elementary transducers 6 arranged side-by-side; for example, a phased array for sector scanning is composed of sixty-four elementary transducers 6 and a linear array provided for producing rectangular tomograms is composed of one-hundred-ninety-two elementary transducers 6. Each elementary transducer 6 is constructed of a polarized piezoelectric ceramic cuboid that is provided with respective electrodes 8 and 10 at two sides lying opposite one another.

The polarized piezoceramic of the elementary transducers 6 has a relatively high acoustic impedance on the order of magnitude of 35 MRayl, whereas the examination region composed of body tissue has an acoustic impedance on the order of magnitude of 1.5 MRayl.

Without acoustic matching, pronounced reflections that would become disturbingly noticeable as image artifacts would therefore arise given direct coupling of the transducer array 4 to the examination region 3.

Reflections and signal losses are reduced by an acoustic matching layer 12 arranged between the examination region 3 and the electroacoustic transducer part 4. The matching layer 12 has a thickness of approximately one-fourth the wavelength of an acoustic wave in the matching layer 12. For acoustic matching, the matching layer 12 must then have an acoustic impedance on the order of magnitude of 5–10 MRayl.

As a single matching layer, the matching layer 12 is directly adjacent to the surface of the transducer array 4, and is conductively glued to the electrodes 8. The matching layer 16 is connected to a common potential 13, so that no further electrical contacting must be provided for the electrodes 8 of the elementary transducers 6. The electrodes 10 are respectively electrically connected to signal channels (not shown in FIG. 1) which each include delay elements provided for individual control and/or focusing.

A thin protective layer 14 of a plastic precedes the matching layer 12. The acoustic properties of the protective layer 14 are matched to those of the body tissue, so that the protective layer 14 does not degrade the acoustic sound waves.

Figure 2:
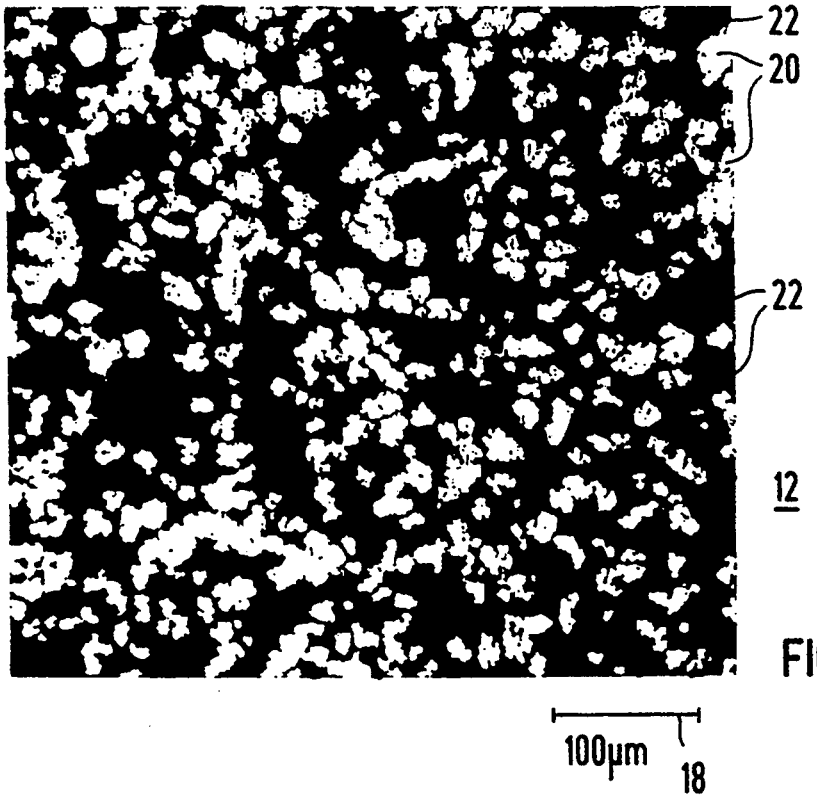
FIG. 2 is micrograph of the surface of an electrically conductive matching layer constructed in accordance with the principles of the present invention.

The structure of the acoustic matching layer 12 shall now be set forth in greater detail with reference to FIG. 2. FIG. 2 shows the micrograph of the surface of the acoustic matching layer 12 magnified 200 times. A scale 18 is also shown for illustrating the orders of magnitude. The acoustic matching layer 12 is composed of an electrically conductive skeleton 20 having interspaces 22 connected to one another. The conductive skeleton 20 touching the surface appears bright in the micrograph, whereas the interspaces 22 filled with a curable casting compound such as, for example, an epoxy resin, appear dark. The skeleton 20 is composed of identical copper particles that are connected to one another by sintering in a protective atmosphere. The size of the particles is smaller than the wavelength of an acoustic wave in the matching layer 12. In the embodiment shown in FIG. 2, the particles are smaller than one-tenth the wavelength, so that practically no scattering occurs.

The acoustic impedance can be set within broad limits via the material of the particles employed and primarily by the volume percentage as well. The volume percentage of the particles can in turn be influenced by the shape and size of the particles. Especially high volume percentages of the particles can be achieved by an additional pressing of the unsintered particles. Further, the volume percentage of the particles can be set by these sintering conditions.

For copper, the following table shows the dependency of the quantities important for matching layers, such as acoustic attenuation and acoustic impedance on the particles, shape, particle size, sintering temperature and sintering time.

| TF | TG µm | ST °C. | SZ min | AD db/MHz mm | AI MRay 1 |
|---|---|---|---|---|---|
| dendritic | 32 | 710 | 30 | 1,6 | 4,7 |
| dendritic | 50 | 950 | 20 | 0,76 | 7,3 |
| spherical | 32 | 720 | 20 | 0,12 | 15,2 |

The abbreviations thereby denote:

TF particle shape
TG particle size
ST sintering temperature
SZ sintering time
AD acoustic attenuation
AI acoustic impedance It is important that the interspaces 22, even given a high volume percentage, are connected to one another, so that they can be filled with casting material without air inclusions.

Given the matching layer 12 shown in the micrograph in FIG. 2, the particles that have been employed are dendritically shaped and have a size of 30–40 µm. Without pressing and given unpressurized sintering, the volume percentage is approximately 18–25%.

The acoustic impedance of the matching layer can be further varied and matched to the acoustic requirements via a combination of different materials, such as materials of different types and/or different particle shapes.

It should also be noted that the above-described matching layer 12 can be equally well employed for acoustic matching of individual transducers. Further, these matching layer 12 can be utilized in therapeutic ultrasound transducer arrangements.

Although modifications and changes may be suggested by those skilled in the art, it is the intention of the inventors to embody within the patent warranted hereon all changes and modifications as reasonably and properly come within the scope of their contribution to the art.

We claim as our invention:

1. A medical ultrasound transducer arrangement for insonifying an examination subject comprising:

an electroacoustic transducer part having an acoustic impedance;

acoustic matching means for matching said acoustic impedance of said transducer part to an impedance of approximately 1.5 MRayl of said examination subject; and said acoustic matching means being composed of sintered metal powder particles and interspaces connected to each other between said particles, said particles having a size which is smaller than the wavelength of an acoustic wave passing through said matching means, and a curable casting compound filling said interspaces.

2. An ultrasound transducer arrangement as claimed in claim 1 wherein said acoustic matching means has a total volume, and wherein said particles occupy a volume in said acoustic matching means between 5% and 95% of said total volume.

3. An ultrasound transducer arrangement as claimed in claim 1 wherein said acoustic matching means has a total volume, and wherein said particles occupy a volume in said acoustic matching means between 10% and 60% of said total volume.

4. An ultrasound transducer arrangement as claimed in claim 1 wherein said particles are identical.

5. An ultrasound transducer arrangement as claimed in claim 1 wherein said particles are dendritically shaped.

6. An ultrasound transducer arrangement as claimed in claim 1 wherein said particles are spherically shaped.

7. An ultrasound transducer arrangement as claimed in claim 1 wherein said particles contain copper.

8. An ultrasound transducer arrangement as claimed in claim 1 wherein said casting compound is a curable synthetic resin.

9. An ultrasound transducer arrangement as claimed in claim 1 wherein said transducer part has a surface and wherein said acoustic matching means is immediately adjacent said surface.

* * * * *